US007673623B2

(12) United States Patent
Maekawa

(10) Patent No.: US 7,673,623 B2
(45) Date of Patent: Mar. 9, 2010

(54) IGNITION COIL DEVICE

(75) Inventor: Toshio Maekawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 549 days.

(21) Appl. No.: 11/538,541

(22) Filed: Oct. 4, 2006

(65) Prior Publication Data

US 2007/0235013 A1 Oct. 11, 2007

(30) Foreign Application Priority Data

Apr. 11, 2006 (JP) ..... 2006-108679

(51) Int. Cl.
*F02P 3/02* (2006.01)
*H01T 13/00* (2006.01)

(52) U.S. Cl. ..... 123/635; 123/143 C

(58) Field of Classification Search ..... 123/634, 123/635, 169 PA, 169 PH, 143 C; 313/11.5; 439/125–130; 277/313, 591, 594, 596, 600
See application file for complete search history.

(56) References Cited

U.S. PATENT DOCUMENTS 5,537,983 A * 7/1996 Nakajima ..... 123/635
5,628,298 A * 5/1997 Murata ..... 123/635
5,771,870 A * 6/1998 Satou et al. ..... 123/635
5,799,633 A * 9/1998 Miller ..... 123/143 C
5,944,002 A * 8/1999 Tracy et al. ..... 123/635
6,023,215 A * 2/2000 Sakamaki et al. ..... 336/96
6,169,471 B1 * 1/2001 Sakamaki et al. ..... 336/96
2008/0029074 A1 * 2/2008 Anzo et al. ..... 123/634

FOREIGN PATENT DOCUMENTS

JP 6-58237 A 3/1994
JP 11-191476 A 7/1999
JP 2004-324434 A 11/2004
JP 2006-060007 A 3/2006

OTHER PUBLICATIONS

Japanese Office Action dated Apr. 22, 2008.

* cited by examiner

*Primary Examiner*—Stephen K Cronin
*Assistant Examiner*—Sizo B Vilakazi
(74) *Attorney, Agent, or Firm*—Sughrue Mion, PLLC

(57) ABSTRACT

An ignition coil device mounted on the cylinder head of an internal combustion engine. The ignition coil includes: a cylindrical pipe inserted into a plug hole while a first clearance is formed between the cylindrical pipe and the plug hole; a coil tower arranged over the cylindrical pipe; a seal member arranged below the coil tower for sealing the plug hole; and a cover arranged between the seal member and the coil tower. The seal member is formed with an air bleeding hole extending from the first clearance to a side of the coil tower. The air bleeding hole includes a protruding opening. A circumferential wall portion is positioned on the outer circumference side of the protruding opening while a second clearance is formed between the cover and a periphery of the protruding opening.

6 Claims, 4 Drawing Sheets

IGNITION COIL DEVICE

BACKGROUND OF THE INVENTION

1. Field of the Invention

The invention relates to an ignition coil device to be used mainly in an internal combustion engine (or engine) and, more particularly, to a configuration for mounting the ignition coil device in the cylinder head of the engine.

2. Description of the Related Art

An ignition coil device of related art has a cylindrical pipe to be electrically connected with an ignition plug. Over this cylindrical pipe, there is arranged a coil tower, which includes a connector for electric connections with the outside and a flange portion to be fixed on the cylinder head. In this ignition coil device, a cylindrical pipe portion is inserted into a plug hole arranging the ignition plug while a clearance is formed therebetween, and the coil tower is arranged over the cylinder head of the engine. Moreover, a seal member is arranged below the coil tower so as to prevent water droplets from intruding into the plug hole. Since the plug hole has the waterproofing configuration therein, moreover, the seal member is provided with an air bleeding hole for preventing the deterioration of the sealing properties, as might otherwise be caused by thermal expansion or shrinkage.

JP-A-6-58237 discloses an air bleeding hole of an ignition coil device that is constituted by forming the air bleeding hole in a seal flange in parallel with the plug hole, by forming a concentric air bleeding groove in a holding plate below the coil tower, and by extending the air bleeding hole therethrough toward over the coil tower, so that the air in the plug hole may be ventilated through those groove and hole. The air bleeding hole has a complicated configuration, and the final hole opening to the atmosphere is directed upward, so that the configuration has problems in the waterproofing properties when it is employed in places of a two-wheeled vehicle or a ship, where many water droplets are splashed. In some configurations, therefore, the holes are positioned below the flange or the connector.

On the other hand, a configuration of an ignition control device disclosed in JP-A-11-191476 has two pieces of a seal member having an air bleeding hole and a rain cover, both of which bear the retention of the waterproofing properties of the plug hole. The configuration of the air bleeding hole exists in the seal member and is simple, but the rain cover needs a shape having a ring area or a straight area, which is essential in its directional determination. Moreover, the air bleeding opening and the cylinder opening are flush with each other so that the configuration easily allows introduction of water droplets in case a bank shape is absent around the cylinder hole.

SUMMARY OF THE INVENTION

The invention has been made in view of above circumstances and provides an ignition coil device, which can reduce the cost and can be easily assembled, by simplifying the aforementioned air bleeding configuration to prevent the intrusion of splashed water droplets, and an ignition coil device, which can ventilate the inside of a plug hole.

According to an aspect of the invention, there is provided an ignition coil device mounted on the cylinder head of an internal combustion engine. The ignition coil includes: a cylindrical pipe inserted into a plug hole while a first clearance is formed between the cylindrical pipe and the plug hole, the cylindrical pipe being connected with an ignition plug; a coil tower arranged over the cylindrical pipe; a seal member arranged below the coil tower for sealing the plug hole; and a cover arranged between the seal member and the coil tower. The seal member includes: a first portion to be inserted into the plug hole; and a second portion for abutting against an upper face of the cylinder head. The seal member is formed with an air bleeding hole extending from the first clearance to a side of the coil tower. An opening of the air bleeding hole on the side of the coil tower includes a protruding opening protruding from the second portion. The cover is different member from the seal member and includes a circumferential wall portion extending toward the second portion on an outer circumference of the cover. The cover is regulated in a positional relation between the cover and the seal member by a regulating member. The circumferential wall portion is positioned on the outer circumference side of the protruding opening while a second clearance is formed between the cover and a periphery of the protruding opening. A lower end of the circumferential wall portion extends toward the second portion farther than an upper end of the protruding opening.

According to the above configuration, the seal member achieves the waterproofing configuration and the air bleeding configuration, and protects splashed water droplets while retaining an air passage with the simple positional relation between the cover and the seal member, thereby to improve the waterproofing properties, to simplify the air bleeding configuration, to lower the cost, and to facilitate the assembly without any necessity for positioning the air bleeding opening.

BRIEF DESCRIPTION OF THE DRAWINGS

Embodiments of the present invention will be described in detail based on the following figures, wherein.

DETAILED DESCRIPTION OF THE INVENTION

First Embodiment

Figure 1A:
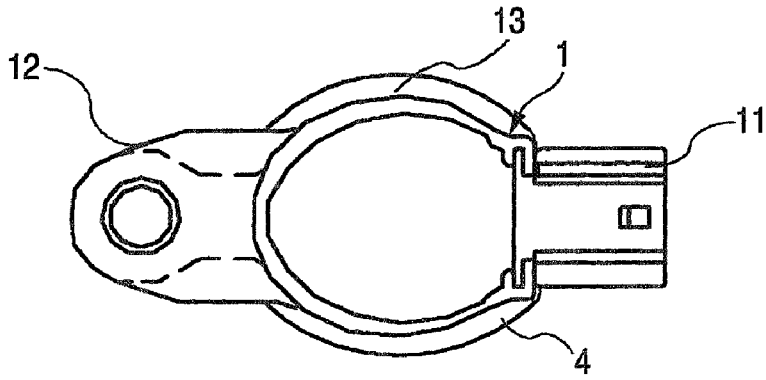
FIGS. 1A and 1B are entire views of an ignition coil device according to a first embodiment of the invention.
Figure 1B:
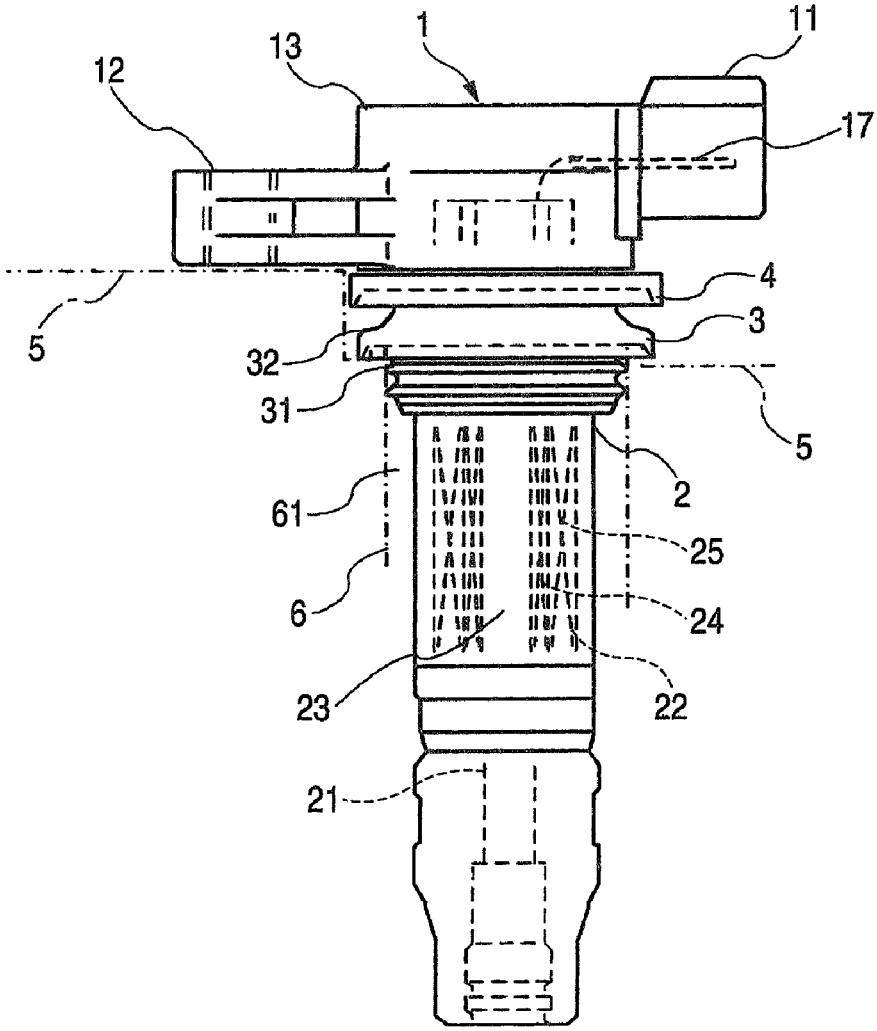

An ignition coil device according to a first embodiment of the invention is described with reference to the accompanying drawings. FIGS. 1A and 1B show an entirety of the ignition coil device. FIG. 1A is a top plan view, and FIG. 1B is a front elevation. The ignition coil device comprises a coil tower (1), a cylindrical pipe (2), a seal member (3) and a cover (4). The coil tower (1) is configured to include: a connector (11) for the electric connection of the device from the outside; a flange (12) for mounting the device on the upper face of the cylinder head (5) of an engine; and a tower body (13). A connector terminal (17) is inserted into the connector (11) so that it is connected with a primary coil constituting a transformer. In the ignition coil device of this type, the tower body (13) has a relatively small size. Throughout the following description, the coil tower (1) is located upward, and the cylindrical pipe (2) is located downward.

The cylindrical pipe (2) is inserted into a plug hole (6) while a first clearance (61) is formed between the cylindrical pipe (2) and a plug hole (6). A terminal (21) to be connected with the (not-shown) ignition plug is inserted into the lower portion of the cylindrical pipe (2). A rod-shaped laminated core (23), and a primary coil (24) and a secondary coil (25) wound around the core (23) are inserted into the upper portion of the cylindrical pipe (2). The core (23), the primary coil (24) and the secondary coil (25) constitutes the transformer (22), and one terminal of the secondary coil (25) is connected with the terminal (21).

The seal member (3) is arranged between the coil tower (1) and the cylindrical pipe (2), and is constituted to include a first portion (31) for sealing the plug hole (6) and the cylindrical pipe (2), a second portion (32) for abutting against the upper face of the cylinder head (5), and a third portion (36 shown in FIG. 2A) extending upward of the second portion (32). The seal member (3) is made of an elastic member (e.g., rubber) to be pressed to contact with the inner circumference of the plug hole (6) and the outer circumference of the cylindrical pipe (2). Moreover, the second portion (32) extends on the outer circumference side of the upper face of the plug hole (6) so that it may abut against the cylinder head (5) thereby to prevent intrusion by water droplets. On the other hand, the cover (4) is arranged separately of the seal member (3) between the coil tower (1) and the seal member (3).

Figure 2A:
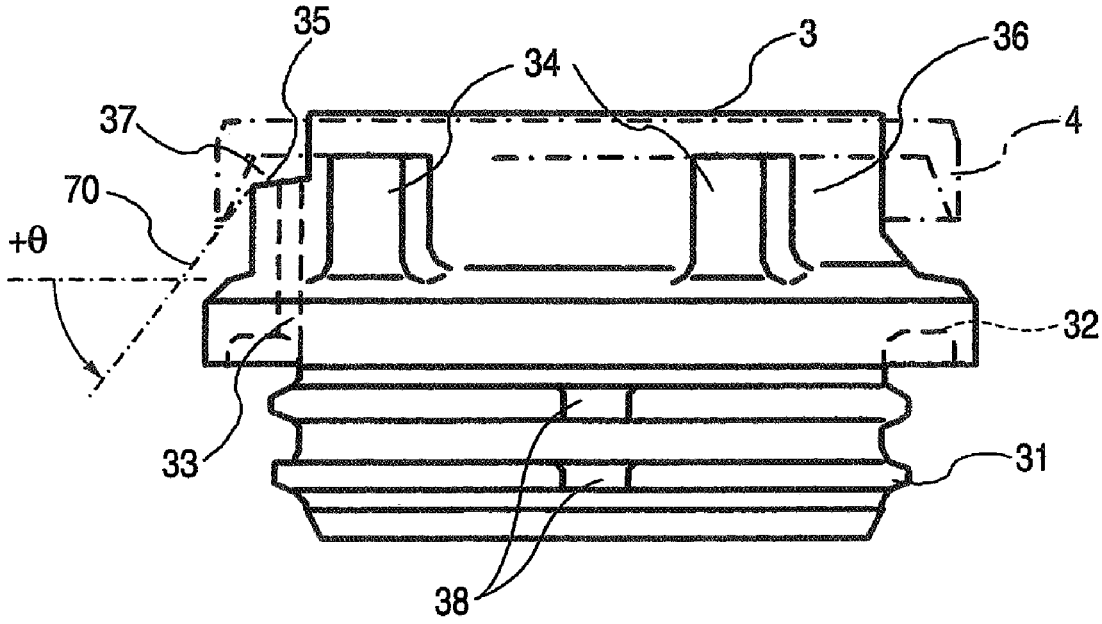
FIGS. 2A and 2B are schematic views showing essential portions of an ignition coil according to the first embodiment of the invention.

Next, the details of the seal member and the cover are explained with reference to FIGS. 2A and 2B. The seal member (3) shown in FIG. 2A is provided, in addition to the first portion (31) and the second portion (32), with at least one air bleeding hole (33), which is positioned in the clearance (61 shown in FIG. 1B) between the plug hole and the cylindrical pipe so as to ventilate the plug hole (6). This air bleeding hole (33) has a funnel shape (35) protruding straight generally in parallel with the cylindrical pipe from the second portion. Without this air bleeding hole, the plug hole inside rises during the engine action to a high temperature. When the temperature drops after the engine stop, the plug hole may be thermally expanded or shrunken to deteriorate the sealing properties of the first portion (31) and the second portion (32). For example, a vacuum of about −150 mmHg is established in case the plug hole has a diameter of 25 mm and a length of about 120 mm and in case the temperature difference is 100 degrees. This makes the air bleeding mechanism essential. However, water droplets may be sucked, if sticking to the vicinity of the air bleeding hole, into the plug hole (6). Counter-measures are necessary against that suction. Over the second portion (32), on the other hand, there are arranged a plurality of pillars (34), on which the cover (4) rides. The protruding opening (35) for the air bleed is set lower than the pillars (34) so that a clearance (37) is established between the cover (4) and the periphery of the opening of the air bleeding hole (33). Moreover, the first portion (31) is provided with a partially notched portion (38), which can retain an air passage even if the first portion (31) abuts against and crushes the inner circumference of the plug hole (6).

Figure 2B:
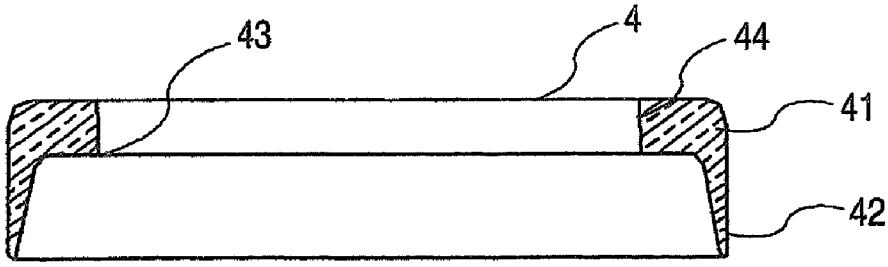

FIG. 2B shows a sectional shape of the cover (4). This cover (4) is composed of a fourth portion (41) extended in the direction perpendicular to the cylindrical pipe (2), and a circumferential wall portion (42) extended downward from the fourth portion (41). On the other hand, a cover innermost circumference (44) is provided with a circular hole, which abuts against the outer circumference of a third portion (36) of the seal member. The seal member (3) and the cover (4) can retain their sealing properties easily, if they are made of an elastic material such as a rubber member and if the diameter of the cover innermost circumference is made equal to or less than the outer circumference diameter of the third portion (36). Moreover, the inner circumference back 43 is arranged to ride on the upper faces of the pillars (34). As a result, these pillars (34) act as regulating members for the cover (4). The air bleed protruding opening (35) is set lower than the pillars (34) so that the air passage of the second clearance (37) can be retained with the simple configuration. On the other hand, the fourth portion (41) is extended farther to the outer circumference than the air bleed protruding opening (35) so that it plays the role of a hood for the air bleed. Moreover, the configuration has the clearances not only above but also around the protruding opening (35) so that it has an effect to prevent the water intrusion against the splashed water droplets while retaining the air passage.

The lower end of the circumferential wall portion (42) of the cover is extended downward from the upper face opening of the air bleed protrusion (35) thereby to make an overlap, the allowance of which can be determined in the following manner. An auxiliary line (70), as shown in FIG. 2A, is tangent to the upper end of the lowermost end of the circumferential wall portion (42) and the upper end of the protruding opening (35) such that the angle (θ) between the auxiliary line and the horizontal line is set plus, as shown. In short, the angle is set lower than horizontal. Even if the angle, at which the ignition coil device (1) is mounted in the cylinder head, is not so vertical as is shown but is inclined, there arises no fear that the water droplets intrude into the air bleeding hole so long as that angle (θ) is set plus. Thus, this setting of the angle makes it possible to retaining the water-proofing properties as well as the air passage. Considering the environment for mounting the ignition coil device, the angle (θ) is set sufficiently plus to become effective for not only the splashed water droplets but also the falling water droplets.

On the other hand, the fourth portion (41) of the cover is set as thick as or slightly thinner than the third portion (36) of the seal member. In case the coil tower (1) is mounted on the cylinder head (5), it pushes the second portion (32) of the seal member thereby to retain the waterproofing properties with the cylinder head. At this time, considerations are taken such that the pressing relations may not be affected by the cover (4). The configuration is made to retain the waterproofing properties of the cylinder head only with the coil tower (1) and the seal member (3) so that the configuration can be simplified to lower the cost.

The tower body (13) is so relatively small that its projected contour area can be smaller than those of the second portion (32) of the seal member and the fourth portion (41) of the cover. Therefore, the inner diameter of the cover or the circumferential wall portion (42) is made larger than the outer circumference of the protruding opening (35). Alternatively, the outer diameter of the circumferential wall portion (42) is made equal to or larger than that of the second portion (32) so that the waterproofing effect is further improved on the falling water droplets. Moreover, the upper face of the second portion (32) is sloped downward toward the outer circumference so that it is effective to prevent the intrusion of the water droplets. In short, the downward slope prevents the water droplets from staying. Moreover, a clearance is also made between the lowermost end of the circumferential wall portion (42) and the second portion (32) thereby to permit the flow of the water droplets. If, moreover, the seal member (3) and the fourth portion (41) of the cover are made circular, the seal member (3) and the cover (4) need not be positioned with respect to the coil tower (1), the cylindrical pipe (2) and the protruding opening (35) thereby to facilitate their assembly. Still moreover, the pillars (34) are arranged on the seal member (3), but similar effects can be attained even if the pillars (34) are arranged on the cover (4).

Second Embodiment

Figure 3A:
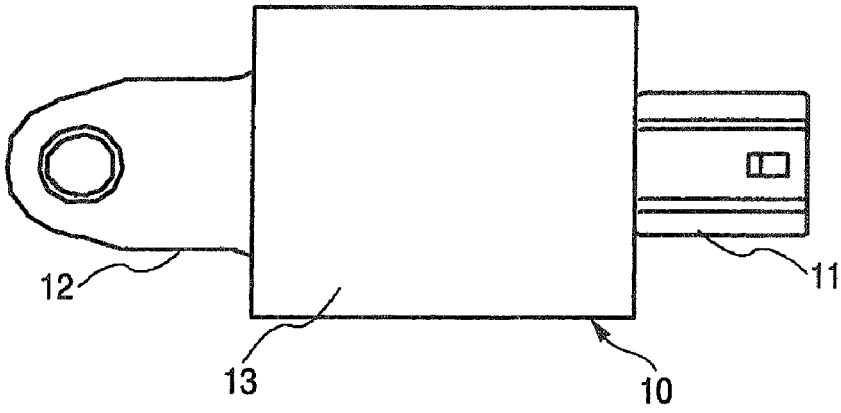
FIGS. 3A and 3B are entire views of an ignition coil device according to a second embodiment of the invention.
Figure 3B:
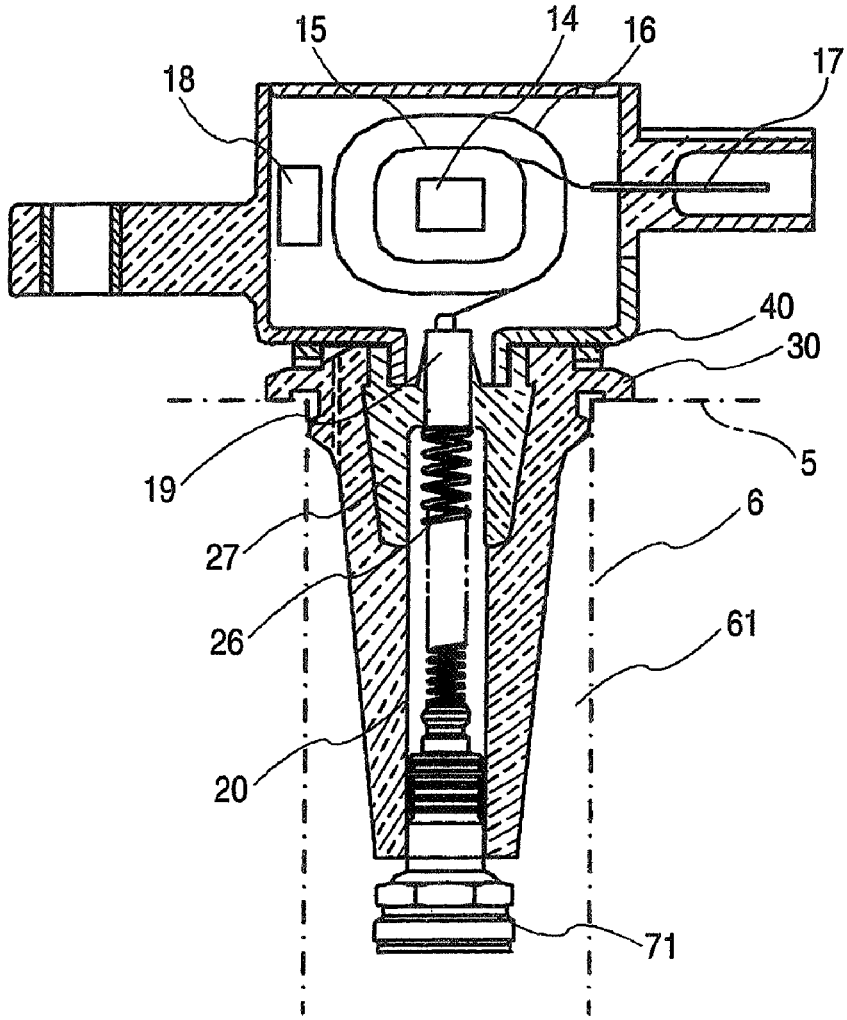

A second embodiment of the invention is described with reference to FIGS. 3A and 3B. Here, the same reference numerals as those of FIGS. 1A and 1B designate the identical or corresponding portions. FIG. 3A is a top plan view of the ignition coil device, and FIG. 3B is a sectional front elevation. Especially the transformer configuration is embedded in the coil tower. Specifically, the coil tower (10) includes a core (14) arranged at the center, and a transformer having a primary coil (15) and a secondary coil (16) wound on the outer circumference of the core. The primary coil (15) is connected with the connector terminal (17) of the connector (11). On the other hand, the secondary coil is connected at its one end with a high-voltage terminal (19). There is also arranged an IC (18), in which a switching element or the like for driving the transformer is embedded. In the ignition coil device of this type, the coil tower body is relatively large-sized. Specifically, the projected area of the coil tower body has a tendency to become than those of a seal member (30) and a cover (40), which are located thereunder.

A coiled conducting member (26) for connecting an ignition plug (71) and the high-voltage terminal (19) is embedded at the center of a cylindrical pipe (20), and a high-voltage tower (27) enclosing the high-voltage terminal (19) and connected with the tower body (13) is arranged in the upper portion of the cylindrical pipe (20). On the other hand, the seal member (30) is formed to contain the cylindrical pipe (20), the conductive member (26) and the high-voltage tower (27). Moreover, the cover (40) is arranged between the tower body (13) and the seal member (30).

Figure 4A:
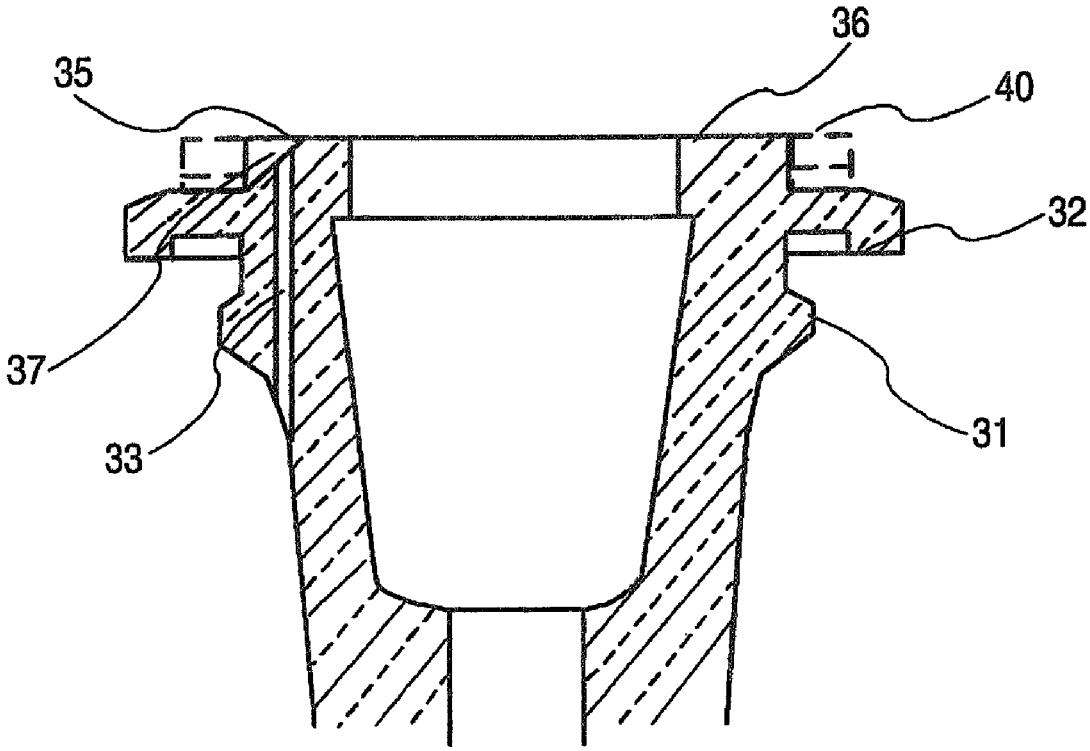
FIGS. 4A and 4B are schematic views showing essential portions of an ignition coil according to the second embodiment of the invention.
Figure 4B:
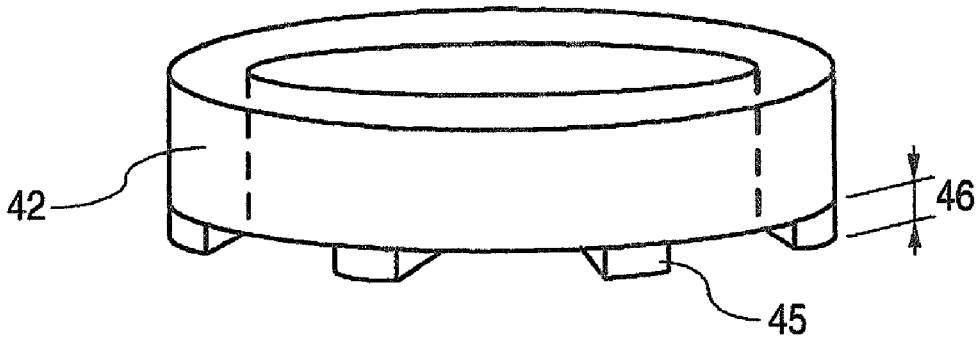

Next, the seal member (30) and the cover (40) are explained with reference to FIGS. 4A and 4B. In the sectional view shown in FIG. 4A, the seal member (30) includes the first portion (31) to be pressed to contact with the inner circumference of the plug hole (6), and the second portion (32) to abut against the upper face of the cylinder head (5), and the air bleed protruding opening (35) extends upward from the second portion (32). The air bleeding hole (33) is positioned in and linearly through the clearance between the plug hole (6) and the seal member (30). The air bleed protruding opening (35) is positioned on the radially inner side of the outermost circumference of the third portion (36), and sets the opening at a position lower than the upper face of the third portion (36). With this shape, the clearance (37) can be formed around the air bleed opening thereby to retain the air passages. On the other hand, the upper face of the air bleed opening is sloped toward the outer circumference so that the water droplets do not stay but flow. Moreover, it is desired that the upper face of the second portion is also sloped to the outer circumference.

In the ignition coil device of the type having a relatively large coil tower, on the other hand, the tower body (13) can be expected to act as a roof. Even if, therefore, the shape of the cover (4) according to the first embodiment is not employed, it is possible to use a cover shown in FIG. 4B. This cover is basically formed into a doughnut shape constituted of the circumferential wall portion (42) and having a plurality of legs (45) at its lower portion. The height (46) of the cover lower portion by those legs (45) forms such a clearance (i.e., a third clearance) for permitting the flow of water droplets. On the other hand, the height of the cover entirety containing the legs (45) is substantially equal to the clearance between the coil tower and the second portion of the seal member. On the other hand, the innermost circumference of the cover need not constitute the roof entirety positively with the cover, because the coil tower is large, and need not cover the upper face of the air bleed protruding opening (35). This cover is simplified in shape so that it can make the cost lower.

The invention can be used not only as the ignition coil device of an internal combustion engine for vehicles but also as the ignition coil device for ships, aircraft and so on.

The entire disclosure of Japanese Patent Application No. 2006-108679 filed on Apr. 11, 2006 including specification, claims, drawings and abstract is incorporated herein by reference in its entirety.

What is claimed is:

1. An ignition coil device mounted on a cylinder head of an internal combustion engine, the ignition coil device comprising:

a cylindrical pipe having a transformer configuration inserted into a plug hole while a first clearance is formed between the cylindrical pipe and the plug hole, the cylindrical pipe being connected with an ignition plug;

a coil tower arranged over the cylindrical pipe;

a seal member arranged below the coil tower for sealing the plug hole and the cylindrical pipe; and a cover arranged between the seal member and the coil tower, wherein the seal member includes:

a first portion to be inserted into the plug hole, a second portion for abutting against an upper face of the cylinder head, a third portion extending upward of the plug hole further than the first portion, and regulating members extending away from the second portion and positioned around the third portion, the seal member includes an air bleeding hole extending substantially in parallel with the cylindrical pipe from the first clearance to a side of the coil tower, an opening of the air bleeding hole on the side of the coil tower includes a protruding opening protruding from the second portion and including an upper face opening which is inclined downward toward a radial outside direction, wherein the regulating members protrude higher than the protruding opening a direction away from the second portion, the cover is a different member from the seal member and includes a fourth portion perpendicular to the cylindrical pipe and a circumferential wall portion extending toward the second portion on an outer circumference end of the fourth portion, the cover is regulated in a positional relation between the cover and the seal member by the regulating members, the fourth portion abuts, at an innermost circumference of the fourth portion, against an outer circumference of the third portion and, at a bottom surface, an upper surface of the regulating members, while a second clearance is formed between a back of the fourth portion on a side of the second portion and the protruding opening, and the circumferential wall portion extends at a lower end of the circumferential wall toward the second portion farther than an upper end of the protruding opening to form a third clearance between an inner circumference of the circumferential wall portion and the protruding opening, and has a larger inner diameter than a diameter of an outer circumference of the protruding opening.

2. The ignition coil device according to claim 1, wherein the coil tower includes a flange for fixing the coil on the cylinder head, and the second portion of the seal member is pushed by fixing the flange portion on the cylinder head.

3. The ignition coil device according to claim 1, wherein the cover is not thicker than a distance between the seal member and the coil tower when the coil tower is fixed on the cylinder head.

4. The ignition coil device according to claim 1, wherein the second portion extends over the first portion to overhang over the first portion.

5. The ignition coil device according to claim 4, wherein the cover extends over the second portion.

6. The ignition coil device according to claim 1, wherein the protruding opening protrudes from the second portion into the third portion.

* * * * *